United States Patent [19]

Soughers

[11] 4,368,830

[45] Jan. 18, 1983

[54] LOCKING MEANS FOR LIQUID DISPENSERS

[75] Inventor: Edward K. Soughers, Huntington Beach, Calif.

[73] Assignee: Diamond International Corporation, New York, N.Y.

[21] Appl. No.: 217,743

[22] Filed: Dec. 18, 1980

[51] Int. Cl.[3] ..... B67D 5/42

[52] U.S. Cl. ..... 222/321; 222/384

[58] Field of Search ..... 222/384, 320–321, 222/153, 402.11, 402.14; 215/224, 225, 216; 239/333

[56] References Cited

U.S. PATENT DOCUMENTS

| | | | |
|---|---|---|---|
| 2,846,124 | 8/1958 | Stewart et al. | 222/321 |
| 3,185,355 | 5/1965 | Lipman | 222/384 X |
| 3,248,022 | 4/1966 | Schulman et al. | 239/333 X |
| 3,604,582 | 9/1971 | Boudin et al. | 215/216 X |
| 4,278,187 | 7/1981 | Luedtke | 222/384 X |
| 4,286,736 | 9/1981 | Corsette | 222/153 X |

*Primary Examiner*—Charles A. Marmor

*Attorney, Agent, or Firm*—Watson, Cole, Grindle & Watson

[57] ABSTRACT

In a liquid dispenser, the pump plunger having a discharge head thereon is locked to the closure cap on a liquid container against relative displacement. A pair of opposed locking elements, attached to the side wall of the discharge head, each having a locking pawl thereon for engagement with inwardly extending lip portions provided on the cap. The locking elements are spring biased into locking engagement, and are capable of being manually moved from a locking position to an unlocking position in which the locking pawls are out of engagement with the lip portions. When out of engagement, the locking elements are retained in their unlocking position to avoid any interference between the locking pawls and the annular lip during plunger reciprocation.

6 Claims, 9 Drawing Figures

LOCKING MEANS FOR LIQUID DISPENSERS

BACKGROUND OF THE INVENTION

This invention relates generally to a liquid dispenser having a pump plunger which reciprocates through an opening in the closure cap of the container for the liquid to be dispensed through a discharge head on the plunger, and more particularly to such a pump in which the pump plunger is locked to the closure cap against relative displacement.

As mentioned in the commonly owned U.S. application Ser. No. 123,168, now U.S. Pat. No. 4,286,736, liquid dispensers of this general type are often provided with some means for locking the plunger against relative displacement. Such locking means may be effected by a threaded engagement between the plunger and the container cap. One of the problems with this type of locking engagement, however, is that unthreading of the plunger during the process of unlocking tends to loosen the cap from the container.

Other plunger immobilization means for liquid dispensers are set forth in U.S. Pat. Nos. 3,797,705, 3,827,605 and 3,827,606 which disclose cam actuated locking fingers and the like. Otherwise, snap locking protective overcaps have been used for locking the plunger against relative displacement.

SUMMARY OF THE INVENTION

It is an object of the present invention to improve upon the prior art locking means for liquid dispensers so as to simplify the locking and unlocking operation by the provision of a plunger locking mechanism which is not only easy to operate but which is likewise simple and economical to manufacture.

Another object of this invention is to provide such a plunger locking mechanism which is automatically locked in place upon depression of the plunger, and which may be simply unlocked manually by depressing at least one or an opposing pair of locking ears which are capable of being retained in place against the discharge head when the dispenser is put to use.

A further object of the present invention is to provide such a locking means for a liquid dispenser wherein the closure cap for the container is provided with an inwardly extending lip, which may be continuous or interrupted, and the locking ears have locking pawls thereon which are urged into locking position with the lip under the action of a spring bias. Thus, upon depression of the plunger, it may be automatically locked as the locking ears snap into place.

Other objects, advantages and novel features of the invention will become more apparent from the following detailed description of the invention when taken in conjunction with the accompanying drawings.

DETAILED DESCRIPTION OF THE INVENTION

Figure 1:
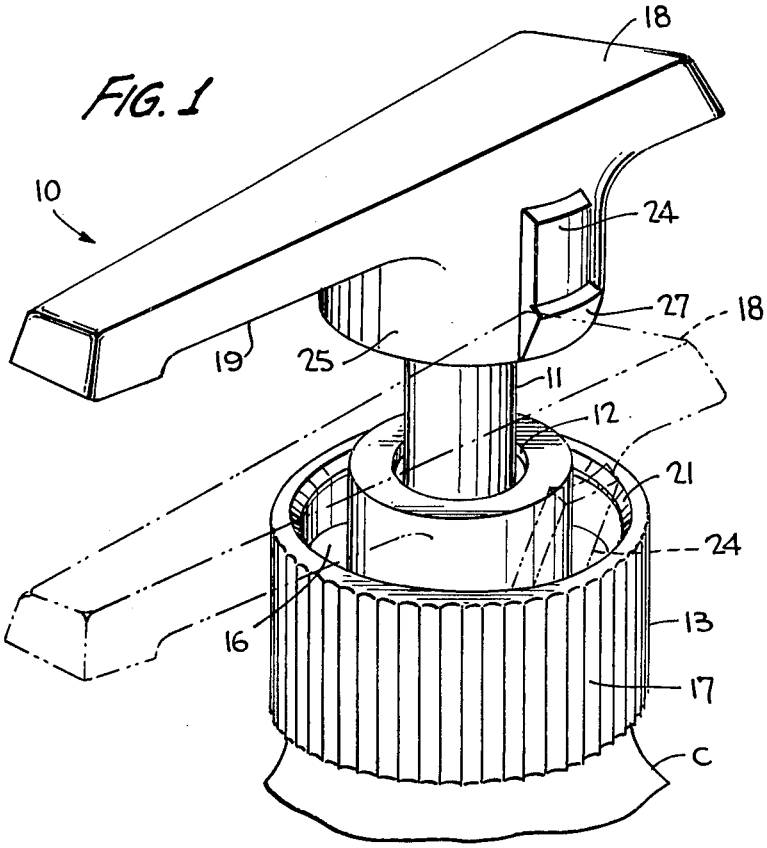
FIG. 1 is a perspective view of a liquid dispenser incorporating the invention and shown in both operational (solid outline) and lock-down (phantom outline positions)
Figure 2:
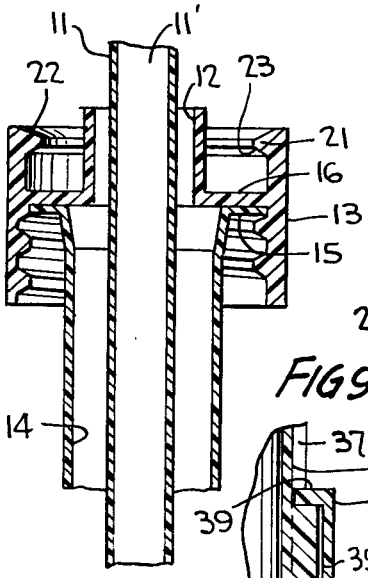
FIG. 2 is a vertical sectional view of the pump plunger and its pump cylinder relative to the container closure cap.
Figure 7:
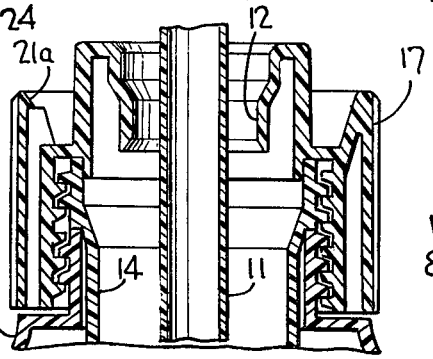

Turning now to the drawings wherein like reference characters refer to like and corresponding parts throughout the several views, a liquid dispensing pump according to the invention is generally designated 10 in FIG. 1 and is shown mounted on a container C, the dispenser including a reciprocable plunger 11 extending through an opening 12 (FIGS. 2 and 7) of the closure cap 13. The cap is internally threaded for engagement with external threads of the container neck, and the piston operates in a pump cylinder 14 for the dispensing of a liquid product from the container during plunger reciprocation against the force of a return spring (not shown), similarly as in the manner disclosed in the aforementioned patent application. The upper end of the pump cylinder may be flanged as at 15 (FIG. 2) so as to bear against the underside of transverse wall 16 of the closure cap, the flange overlying the upper edge of the container when the closure cap is screwed down thereover. The cap may be provided with adjacent vertical knurls 17 to facilitate the loosening and tighting of the closure cap on the container neck. Otherwise, pump cylinder may be externally threaded (FIG. 7) for engagement with the innermost threads of cap 13*a*. The preassembled cap and cylinder may then be threaded on to the neck of container C (FIG. 7).

Figure 6:
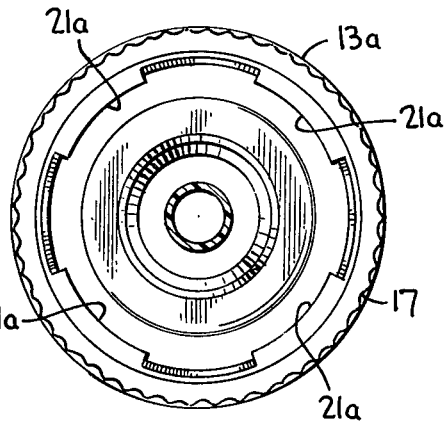
FIGS. 6 and 7 are top plan and vertical sectional views, respectively, of a container closure cap having an interrupted locking lip, FIG. 7 also showing a pump cylinder and a product container assembled with the cap.

A discharge passage 11′, extending through hollow plunger 11 opens into a dispenser head 18 having a discharge spout 19 terminating in a discharge orifice (not shown) which extends via a passageway (not shown) from the hollow plunger. The upper end of the closure cap has an inwardly extending continuous lip 21 defining upper and lower converging sides 22, 23. Otherwise, this inwardly extending lip may be interrupted so as to define lip portions 21*a*, shown in FIGS. 6 and 7. Such portions may be provided to facilitate ease during the molding operation.

Figure 3:
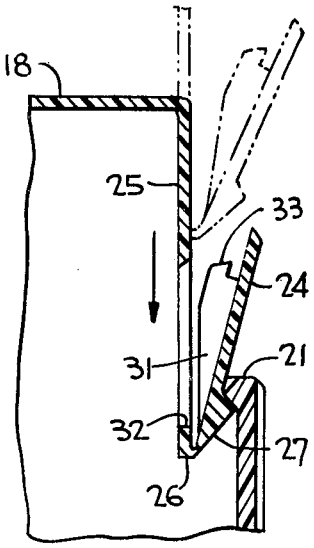
FIGS. 3 and 4 are partial vertical sectional views of the FIG. 1 dispenser and closure cap respectively showing the plunger in lock-down and in operational positions.

A locking ear or element 24 (preferably an opposed pair of such elements, although only one is shown in FIG. 1) is mounted on side wall 25 of the discharge head. The locking element is shown integrally connected to side wall 25 at its lower end so as to define a thin integral hinge 26, although this element can be otherwise mounted in place without departing from the invention. Both the locking element and the discharge head may conveniently be molded or cast from a substantially rigid material such as vinyl plastic, with the locking element being molded or cast in place to lie between about a 45° angle (shown in phantom outline in FIG. 3) and a 90° angle to side wall 25 to thereby induce a springy action to the locking element at hinge 26. And, the locking element is provided at its lower end with a locking pawl 27 having a downwardly and inwardly sloping leading end 28 and a converging upper end 29 which mates with lower side 23 of annular lip 21. With a continuous lip 21, the plunger and plunger head may be allowed to rotate about the central axis thereof, since relative orientation with the locking elements is not necessary. However, with an interrupted lip defining portions 21*a*, the plunger and plunger head will be fixed relative to the closure cap with the locking elements in alignment with opposing pairs of portions 21*a*. Thus, downward movement of the plunger, in the direction of the arrow of FIG. 3, moves the locking member from its position shown in phantom outline therein to its locking position shown in solid phantom outline therein in which mating faces 23 and 29 engage for locking down the plunger against the force of the return spring. Leading end 27 of the locking pawl causes the locking member to pivot inwardly about its hinge 26 as this leading end bears against upper face 22 of the lip during the plunger locking process. And, the induced spring bias for the locking element urges the locking pawl into locking engagement with the annular lip so as to avoid any disengagement between faces 29 and 23 while the plunger is in its locking position.

Figure 4:
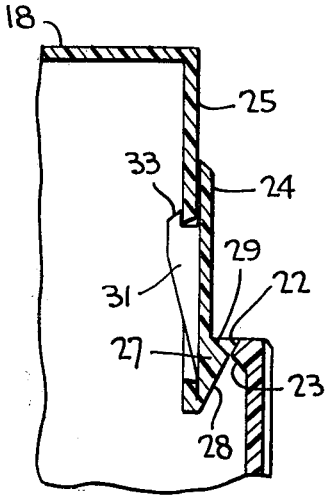

For unlocking the plunger, the operator simply depresses locking element 24 and moves it about its hinge 26 into a position of FIG. 4 lying against the side wall of the discharge head. It should be pointed out that in this position, the confronting outer edges of the locking pawl and of the annular lip are slightly spaced apart so as to avoid any interference between the locking element and the annular lip during plunger reciprocation while the pump is in use. The locking element may be retained in place against the side wall of the discharge head by the provision of a wing 31 which is movable into a slot 32 provided in side wall 25, the wing having an undercut at the top forming a catch 33 which snaps behind the upper edge of slot 32 in the FIG. 4 position.

Figure 9:
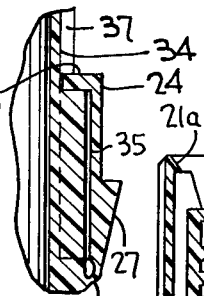
FIGS. 8 and 9 are sectional views taken substantially along lines 8—8 and 9—9 of FIG. 5.
Figure 5:
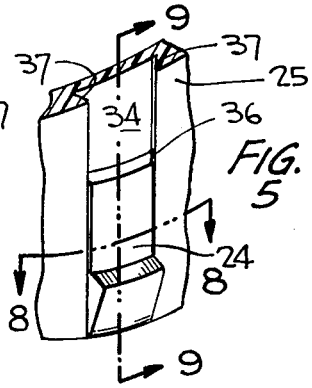
FIG. 5 is a detail view of an alternate means of retaining the locking elements against the side of the discharge head during dispensing.
Figure 8:
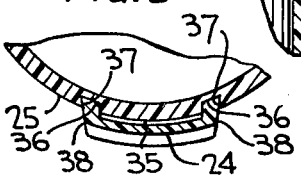

FIGS. 5, 8 and 9 show an alternate means for retaining the locking elements flush against side wall 25 in an unlocking position to facilitate pumping action without interference. A vertical channel 34 is formed in wall 25; a lower portion of this channel, equal to the extent of the locking element (FIG. 9), having a built-up section 35 therein so as to define a pair of spaced grooves 36 confronting element 24. Outer sides 37 of those grooves are outwardly divergent (FIGS. 5 and 8), and the opposing sides of the locking element form walls 28 which are likewise outwardly divergent. Thus, the locking element may be snapped into place upon manual depression thereof as aforedescribed, so as to be tightly retained in place (FIG. 8). An upper end wall 39 of the locking element engages section 35 when locked into place for enhancing the tight fit thereof. This wall and the upper end of section 35 may be angled downwardly to facilitate a snap fit thereat.

From the foregoing it can be seen that the pump plunger of a liquid dispenser is locked against plunger displacement by a locking means which is not only easy to operate but is simple and economical to manufacture, and avoids many of the problems encountered during thread locking the plunger in place. The plunger may be locked into its phantom outline position of the FIG. 1 during shipping or storage of the liquid dispenser while in place on the container. The inlet to the pump cylinder may be sealed closed in this plunger locked down position in some manner according to the prior art or according to that shown in the aforementioned application. After manufacture of the dispenser, the plunger may be automatically locked into place by simply depressing it until its locking element or elements 24 contact lip 21 (or lip portions 21*a*) so as to first move inwardly and then be spring urged outwardly until edges 23 and 29 of the lip and locking pawl, respectively, interengage. The pump may then be put into use as the operator simply depresses the locking element or elements inwardly to be positively retained against the side wall of the discharge head. The locking element is retained in such position by a snap fit with either the upper edge of slot 32, as in FIG. 4, or with the undercut sides of grooves 36 as in FIG. 8. The plunger may then be reciprocated to effect dispensing without interference.

Obviously, many other modifications and variations of the invention are made possible in the light of the above teachings. It is therefore to be understood that within the scope of the appended claims the invention may be practiced otherwise than as specifically described.

What is claimed is:

1. In a dispensing pump of the type in which a pump plunger is disposed for reciprocation through an opening in the closure cap of a container for a product to be dispensed by said pump through a discharge head on said plunger, means for locking said plunger against reciprocation, comprising, an inwardly extending lip portion on said cap, at least one locking element on a side wall of said discharge head, said element having a locking pawl thereon for engagement with said lip portion in a locking position of said plunger, said element being mounted on said side wall for manual movement thereof from said locking position to an unlocking position wherein said locking pawl is out of engagement with said lip portion, and means comprising an opening in said side wall defining a retaining edge, and a catch element on said locking element engageable with said edge for retaining said locking element in said unlocking position to avoid any interference between said locking pawl and said lip during plunger reciprocation.

2. In a dispensing pump of the type in which a pump plunger is disposed for reciprocation through an opening in the closure cap of a container for a product to be dispensed by said pump through a discharge head on said plunger, means for locking said plunger against reciprocation, comprising, an inwardly extending lip portion on said cap, at least one locking element on a side wall of said discharge head, said element having a locking pawl thereon for engagement with said lip portion in a locking position of said plunger, said element being mounted on said side wall for manual movement thereof from said locking position to an unlocking position wherein said locking pawl is out of engagement with said lip portion, groove means in said wall having at least one undercut edge, and said locking element having a corresponding edge engageable with said undercut edge for snap fitting said locking element in place to thereby retain said locking element in said unlocking position to avoid any interference between said locking pawl and said lip during plunger reciprocation.

3. In the pump according to claim 1 or 2, wherein said locking element is hingedly attached to said side wall for movement thereat from said locking position to said unlocking position.

4. In the pump according to claim 1 or 2, wherein said locking pawl is integrally hinged to said side wall and is spring biased away from said side wall for urging said locking pawl into engagement with said lip portion.

5. In the pump according to claim 4, wherein said locking pawl has a sloping leading edge permitting said pawl to be snapped into engagement with said lip portion.

6. In the pump according to claim 3, wherein said locking pawl has a sloping leading edge permitting said pawl to be snapped into engagement with said lip portion.

* * * * *